United States Patent [19]

Rustige

[11] Patent Number: 5,052,905

[45] Date of Patent: Oct. 1, 1991

[54] GEAR MOTOR WITH VALVE CONTROLLED PRESSURE BIASED END-PLATE SEAL

[75] Inventor: Hayno Rustige, Oberrot/Ebersberg, Fed. Rep. of Germany

[73] Assignee: Robert Bosch GmbH, Stuttgart, Fed. Rep. of Germany

[21] Appl. No.: 490,659

[22] PCT Filed: Sep. 2, 1988

[86] PCT No.: PCT/DE88/00541

§ 371 Date: Mar. 12, 1990

§ 102(e) Date: Mar. 12, 1990

[87] PCT Pub. No.: WO89/02515

PCT Pub. Date: Mar. 23, 1989

[30] Foreign Application Priority Data

Sep. 10, 1987 [DE] Fed. Rep. of Germany ..... 8712245
May 14, 1988 [DE] Fed. Rep. of Germany ..... 8806388

[51] Int. Cl.[5] ..... F03C 2/08; F04C 15/00
[52] U.S. Cl. ..... 418/132; 418/14
[58] Field of Search ..... 418/14, 132; 417/299

[56] References Cited

U.S. PATENT DOCUMENTS

| | | | |
|---|---|---|---|
| 3,175,468 | 3/1965 | Miller | 418/14 |
| 3,975,124 | 8/1976 | Dworak et al. | 418/132 |
| 4,281,974 | 8/1981 | Teruyama | 418/132 |
| 4,344,745 | 8/1982 | Herrmann | 418/132 |

FOREIGN PATENT DOCUMENTS

| | | | |
|---|---|---|---|
| 2855567 | 6/1980 | Fed. Rep. of Germany | 418/132 |

*Primary Examiner*—Leonard E. Smith
*Assistant Examiner*—David L. Cavanaugh
*Attorney, Agent, or Firm*—Michael J. Striker

[57] ABSTRACT

A gear motor comprises two meshing gears and a pressure plate pressed against respective lateral surfaces of the gears by pressure in two substantially concentric separate pressure areas arranged on a side of the pressure plate remote from the gears. A control valve controls pressure in one of the pressure areas to adjust a contact pressure of the pressure plate on the gear in such a manner as to increase the contact pressure with an increase in working pressure.

5 Claims, 4 Drawing Sheets

GEAR MOTOR WITH VALVE CONTROLLED PRESSURE BIASED END-PLATE SEAL

BACKGROUND OF THE INVENTION

The invention relates to a gear motor in which a pressure plate is arranged at at least one side of gear wheels and is pressed into engagement therewith by fluid pressure in two concentric preliminary outer and main inner pressure areas with a control valve controlling pressure in the radially inner main pressure area. In such known gear motor, there is the disadvantage that the pressure medium control between the preliminary pressure area and the main pressure area does not function satisfactorily, so that the pressure build up in the main pressure field is not effected in a perfect manner.

SUMMARY OF THE INVENTION

The object of the invention is to provide a gear motor having the advantage that the control of the preliminary and main pressure fields is not problematic, so that operability of the gear motor is accordingly improved. The object of the invention is achieved by connecting the intermediate space between the seals with the tooth chambers by a throttle bore extending through the pressure plate and with the control valve by a fluid conduit.

The present invention both as to its construction so to its mode of operation, together with additional objects and advantages thereof, will be best understood from the following detailed description of the preferred embodiments when read with reference to the accompanying drawings.

DESCRIPTION OF THE PREFERRED EMBODIMENTS

Figure 2:
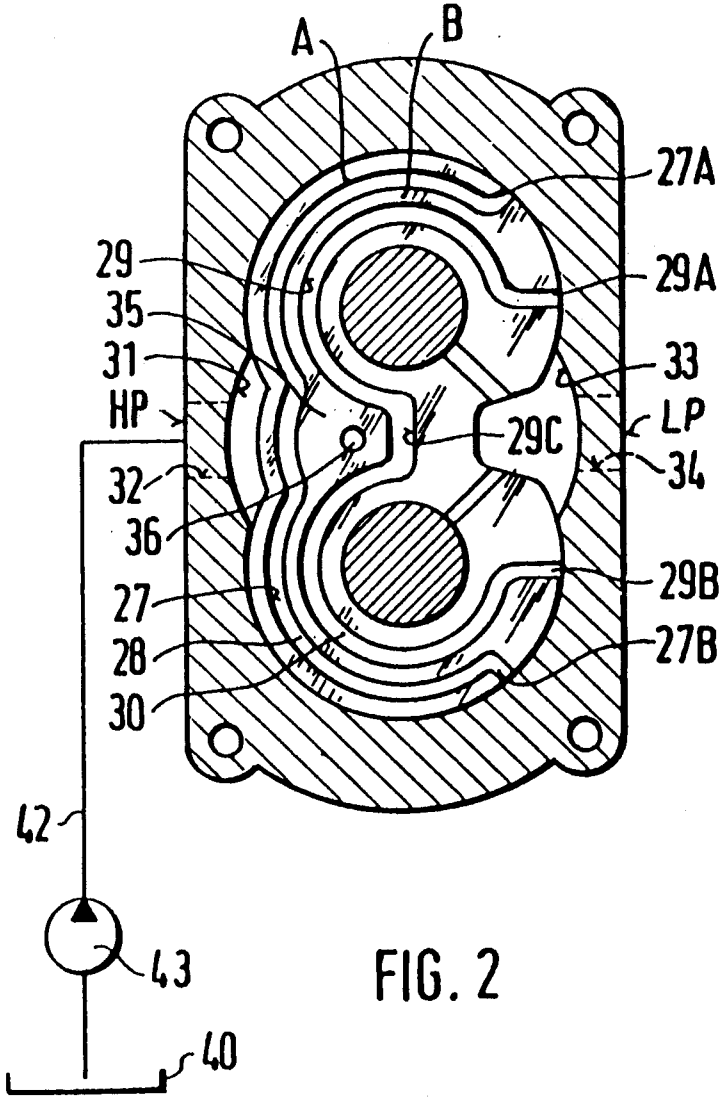
FIG. 2 shows a cross-sectional view along lines II—II according to FIG. 1.
Figure 1:
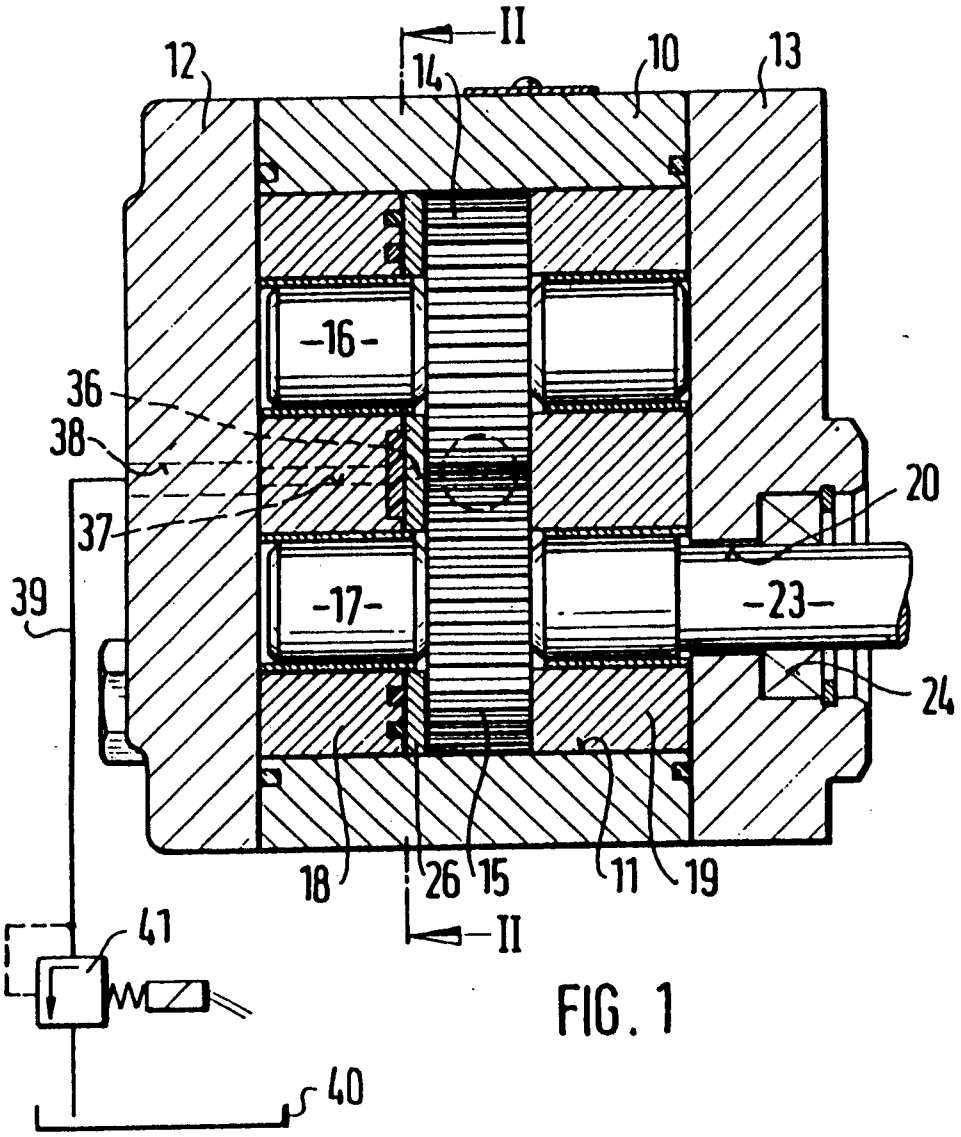
FIG. 1 shows a longitudinal cross-sectional view of a gear through a motor according to the invention.

The gear motor comprises a housing 10 whose interior space 11 has the approximate cross-sectional shape of a numeral eight which is closed at both sides by covers 12, 13. Two gears 14, 15 mesh with one another in external engagement in the interior space, their shafts 16, 17 being supported in bearing bodies 18, 19 having a shape of spectacles. Such bearing bodies are known in general and are therefore not described in more detail. A passage 20 is formed in the cover 13, and an extension 23 of the shaft 17 passes outward through the passage 20. The extension 23 is sealed in this location by a sealing ring 24 and forms a power output shaft.

A pressure plate 26 is arranged between the bearing body 18 and the adjacent lateral surfaces of the gears 14, 15, which pressure plate 26 also has the contour of the housing interior and overlaps the entire surface of the gears. Two pressure areas described below, act on a side of the pressure plate 26 which is opposite to a side thereof that abuts the gears 14 and 15.

FIG. 2 shows a front side view of the bearing body 18 facing the pressure plate 26. A first grooved channel 27 is formed in this front side. It extends in the vicinity of the outer contour of the bearing body, partially concentrically to the gear shafts and runs from the high-pressure side HP to the low-pressure side LP, but does not abut the latter. The grooved channel 27 ends in two groove ends 27A, 27B, respectively, which penetrate forward until the edge of the bearing body. A seal 28 of rubber-elastic work material is arranged in this grooved channel.

A second grooved channel 29, which likewise extends from the high-pressure side to the low-pressure side, is likewise formed so as to be concentric to the gear shafts, but radially inside the grooved channel 27, wherein its ends 29A, 29B penetrate further forward to the low-pressure side than the groove ends of the groove train 27. Moreover, the grooved channel 29 comprises, in its central area, a notch 29C which leads approximately to an imaginary straight line connecting the shaft centers. A seal 30, which likewise comprises a rubber-elastic work material, is suitably arranged in the groove channel 29.

The high-pressure side HP is characterized by a recess 31 into which the high-pressure hole 32 penetrates proceeding from the outside of the housing, specifically at the height of the gears 14, 15. The low-pressure side LP is characterized by a recess 33 penetrated by a low-pressure hole 34 which extends coaxially relative to the high-pressure hole 32 and likewise proceeds from the outside of the housing.

As can be seen from FIG. 2, there is an intermediate space between the channels 27, 29 which forms a somewhat enlarged area 35 in the area 29C, which area 35 is connected with the gear chambers via a continuous throttle bore hole 36 formed in the pressure plate 26. A hole 37 extends in the bearing body 18 coaxially relative to the throttle hole 36 and communicates with a continuous hole 38 formed in the cover 12, a conduit 39 being connected to the hole 38. A valve 41, which can be actuated electromagnetically, is arranged in this conduit which leads to a container 40. This valve 41 can be a switching valve or a proportionally operating electromagnetic valve. A conduit 42 which leads to a pump 43 which sucks pressure medium from the container 40 and feeds it to the gear motor is connected to a high-pressure hole 32.

It is important in the operation of the gear motor that it need overcome only slight friction resistance when starting. This refers particularly to the pressure plate 26 which is to be pressed with only a slight force at the lateral surfaces of the gear when starting. This contact pressure force results from two pressure areas, that is, a so-called preliminary pressure area A and a main pressure area B. The preliminary pressure area A is defined by the seal 28 and extends in the area located radially outside this seal, that is, between the latter and the housing wall, as well as in the area which is located under the surface of the seal 28 itself. The main pressure area B is formed by an area located between the seal 28 and the seal 30, particularly also by the area 35 and is located under the surface of the seal 30 in addition. The preliminary area A is acted upon by the pressure in the recess 31, i.e. the delivery pressure P of the pump 43 prevails in the preliminary pressure area A. The main pressure area is acted upon by a lower pressure which is partly determined in particular by the throttle hole 36. The pressure in the main pressure area is a so-called control pressure Ps which is determined by the valve 41. The pressure in the main pressure field B is fed from the gear chambers via the throttle bore hole 36. When the valve 41 is opened sharply, the pressure Ps in the main pressure area is low, when the valve 41 is closed, the pressure Ps is high.

The valve 41 is opened sharply when starting the gear motor, so that the pressure Ps in the main pressure area B is relatively low. The pressure plate 26 is now pressed against the gears 14, 15 with a slight force. The gear motor can now start easily, since the friction force is low. As the speed increases, the valve 41 is gradually closed, so that the pressure in the main pressure area B increases, and the pressure plate 26 presses against the lateral surfaces of the gears with an increasing force. This has the advantage that the leakage losses past the pressing plate 26 between the low-pressure side and the high-pressure side along the lateral surface of the gears become increasingly smaller. When the valve 41 is entirely closed, pressure medium can no longer flow out of the main pressure area B, so that the pressure plate 26 is pressed against the lateral surfaces of the gears with a predetermined force. The friction force is negligible. The valve 41 can be constructed as a switching valve or as a proportional valve—both electromagnetically actuated. For example, the pulse length can be modulated.

Figure 3:
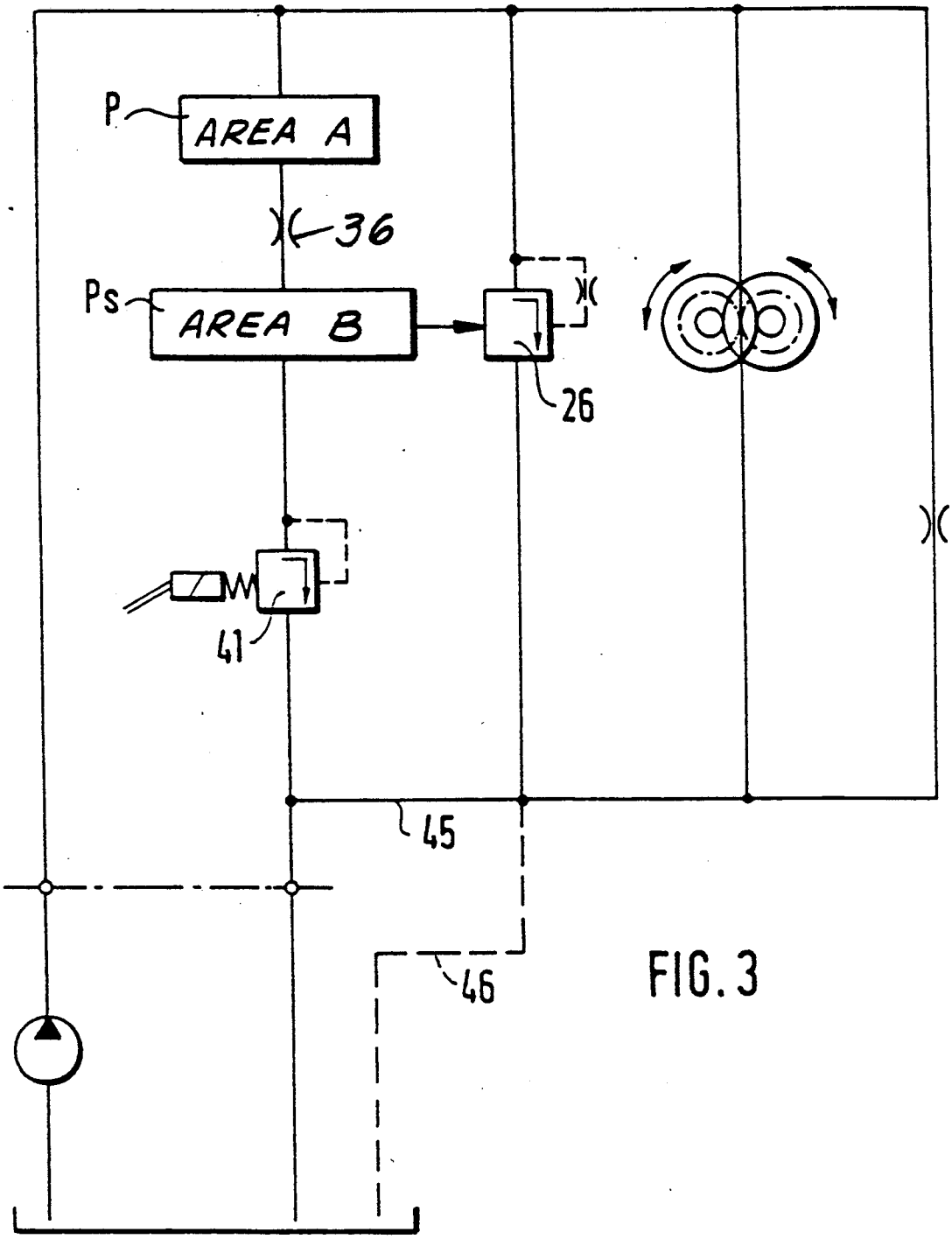
FIG. 3 shows a basic diagram.

This entire process is shown schematically in FIG. 3. The pressure plate 26 is shown here symbolically as a pressure valve 26, since, in itself, it exerts a relief function like a pressure relief valve.

Figure 4:
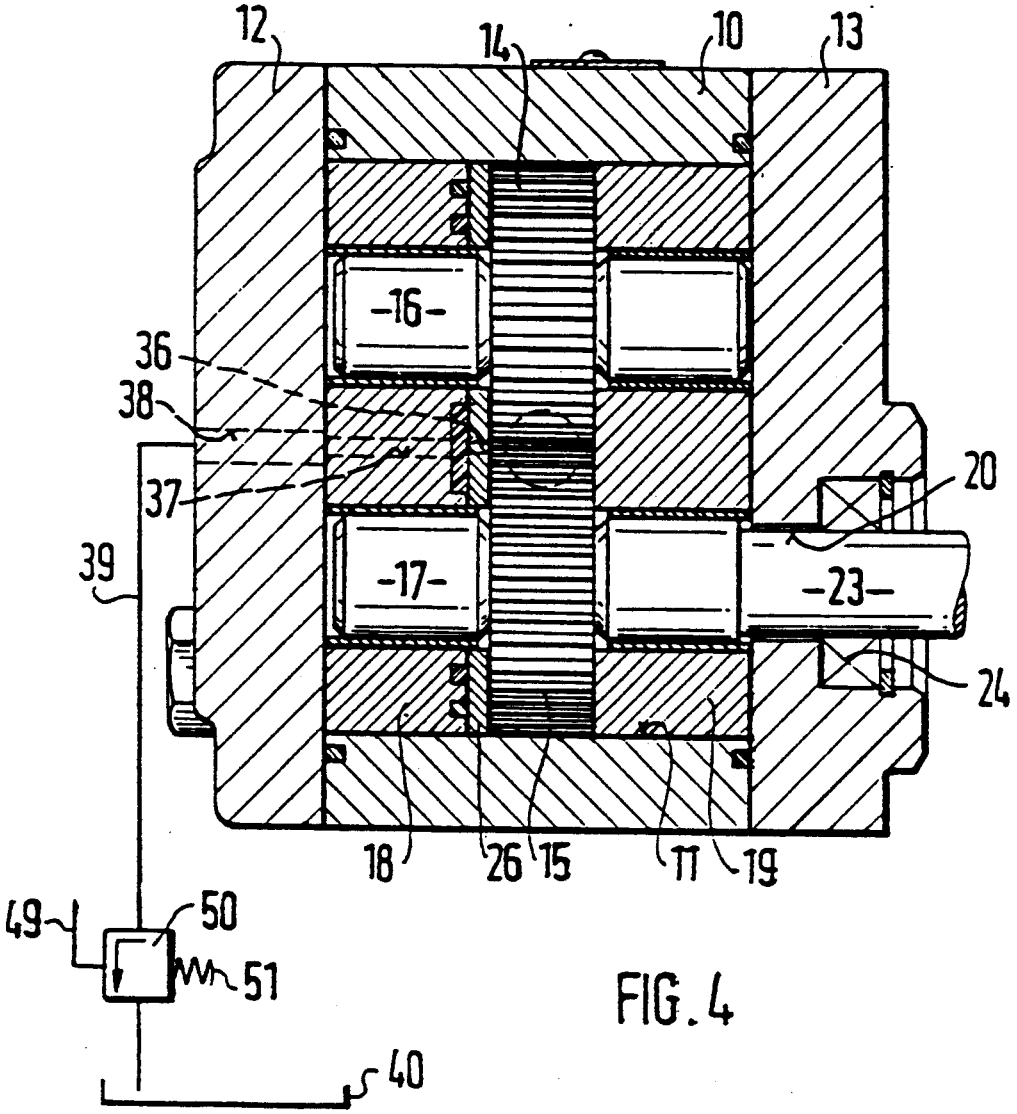
FIG. 4 shows a view similar to that of FIG. 1 of a modified embodiment of a gear motor.
Figure 5:
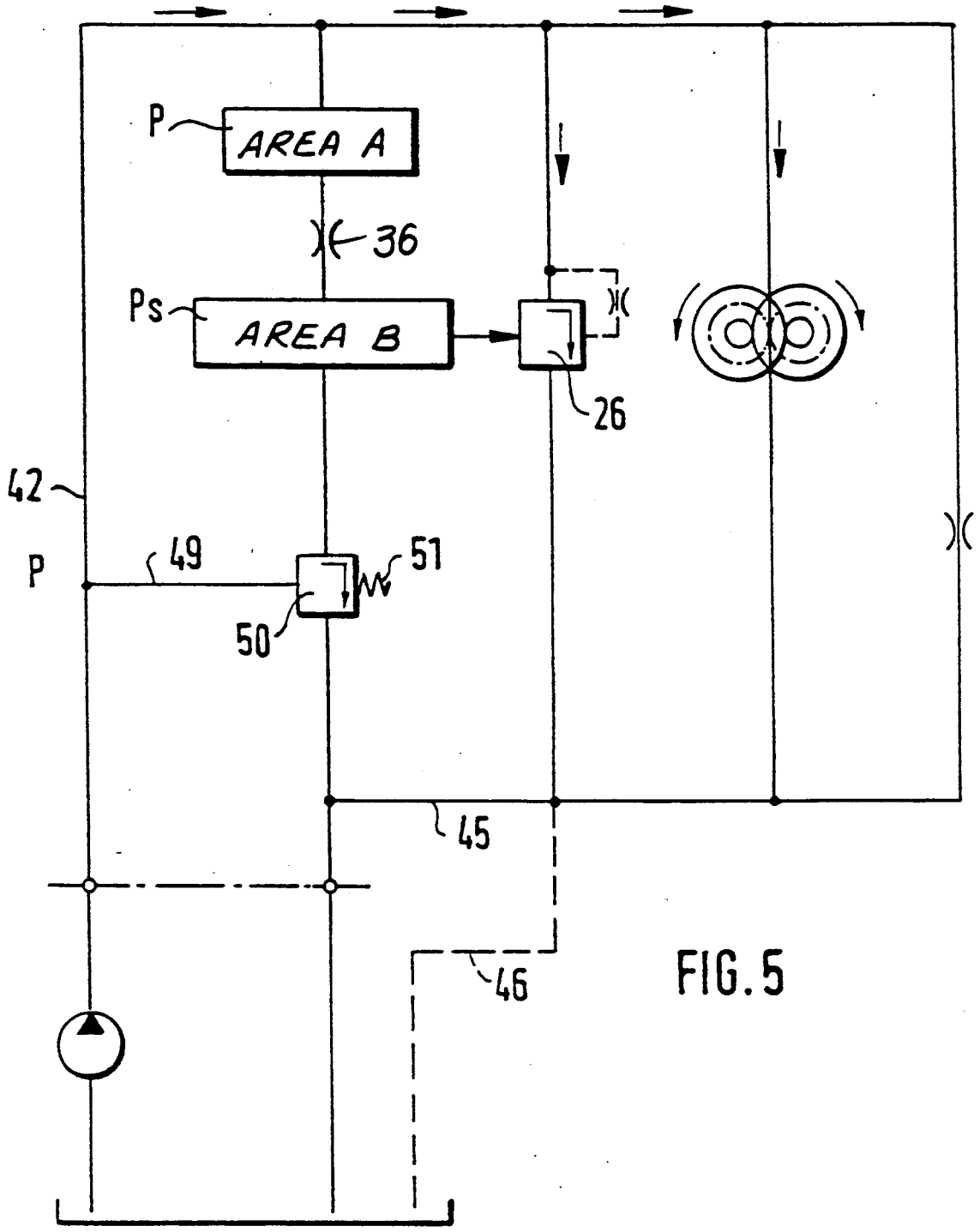
FIG. 5 shows a basic diagram.

FIG. 4 and the construction shown schematically in FIG. 5, are directed to a modification of the above embodiment. The switching valve—now designated by 50—is no longer controlled externally, i.e. by an electromagnet for example, but rather by the pressure in a conduit 49 of the pump branching off from the delivery conduit 42 against the force of a spring 51. Accordingly, a more reliable starting of the gear motor is also achieved. An excessive load moment or blocking leads immediately to the relief (lifting off) of the pressure plate 26 by an amount corresponding to the braking moment of the plate which is exerting contact pressure. In this way, the maximum possible torque is taken from the gear motor. The switching valve is advisably arranged in the cover 12 of the gear motor.

While the invention has been illustrated and described as embodied in a gear motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gear motor, comprising a housing having an inner space; two gears arranged in said inner space and having outer teeth meshing with each other and defining tooth chambers; a pressure plate located in said housing at one side of said two gears and adapted to a contour of said inner space of said housing; radially outer preliminary and radially inner main pressure areas arranged at a side of said pressure plate remote from said two gears; a control valve for controlling pressure in said main pressure area; two seal members for limiting said preliminary and main pressure areas, said main pressure area being defined by a radial space between said two seal members; and means comprising a throttle hole extending through said pressure plate for communicating said main pressure area with said tooth chambers; and means for communicating to said preliminary pressure area a pressure higher than pressure in said main pressure area.

2. A gear motor as set forth in claim 1, wherein said gear motor further comprises conduit means communicating said control valve with said main pressure area; and said preliminary and main pressure areas have portions extending at least partially concentric to each other about axes of said two gears.

3. A gear motor as set forth in claim 2, wherein said control valve is formed as a switching valve.

4. A gear motor as set forth in claim 2, further comprising a spring for biasing said control valve against pressure of a fluid flow in a delivery conduit.

5. A gear motor as set forth in claim 1, wherein said means for communicating to said preliminary pressure area higher pressure is connected with an outlet of a feed pump for feeding pressure medium to said gear motor.

* * * * *